US007356927B2

(12) United States Patent
Chung

(10) Patent No.: US 7,356,927 B2
(45) Date of Patent: Apr. 15, 2008

(54) METHOD FOR MAKING CERAMIC SPHERES

(76) Inventor: Dong-Teak Chung, Grendbil 404-302, 111, Kumi-dong, Bundang-gu, Seongnam-si, Kyeonggi-do (KR) 463-500

( * ) Notice: Subject to any disclaimer, the term of this patent is extended or adjusted under 35 U.S.C. 154(b) by 295 days.

(21) Appl. No.: 10/523,991

(22) PCT Filed: Sep. 18, 2002

(86) PCT No.: PCT/KR02/01752

§ 371 (c)(1),
(2), (4) Date: Feb. 9, 2005

(87) PCT Pub. No.: WO2004/026529

PCT Pub. Date: Apr. 1, 2004

(65) Prior Publication Data

US 2005/0248050 A1 Nov. 10, 2005

(30) Foreign Application Priority Data

Aug. 9, 2002 (KR) ..... 2002-47014

(51) Int. Cl.
*B21D 51/16* (2006.01)

(52) U.S. Cl. ..... 29/899

(58) Field of Classification Search ..... 29/899; 264/138, 162; 451/50
See application file for complete search history.

(56) References Cited

U.S. PATENT DOCUMENTS

| | | | | |
|---|---|---|---|---|
| 3,667,168 | A * | 6/1972 | Brany | 451/50 |
| 3,999,330 | A | 12/1976 | Brany | |
| 5,396,837 | A | 3/1995 | Backus | |

FOREIGN PATENT DOCUMENTS

| | | | |
|---|---|---|---|
| JP | 57-163051 | A | 4/1981 |
| JP | 60-104647 | A | 11/1983 |
| JP | 09/103948 | A | 10/1995 |
| KR | 10 1990 0003387 | B1 | 5/1990 |
| WO | 99/19115 | A1 | 4/1999 |

* cited by examiner

*Primary Examiner*—John C. Hong
(74) *Attorney, Agent, or Firm*—Lowe Hauptman Ham & Berner

(57) ABSTRACT

A method of making ceramic sphere, a pair of rollers and a core drill with a stopper are employed. The rotating core drill in cooperation with the rollers machines a cylinder-shaped ceramic core to make a ceramic sphere. The rotating core drill continuously machines the ceramic sphere in cooperation with the rollers to obtain a ceramic real sphere, while the stopper of the core drill prevents the ceramic sphere from moving upward.

6 Claims, 5 Drawing Sheets

METHOD FOR MAKING CERAMIC SPHERES

RELATED APPLICATIONS

The present application is based on International Application No. PCT/KR2002/001752, filed Sep. 18, 2002, and claims priority from, Korean Application Number 2002/47014, filed Aug. 9, 2002, the disclosure of which is hereby incorporated by reference herein in its entirety.

BACKGROUND OF THE INVENTION

1. Field of the Invention

The present invention relates to a method for making ceramic spheres, and more particularly to a method for making ceramic spheres wherein a ceramic sphere is made out of a cylinder-shaped core machined by a core drill.

2. Description of the Background Art

In recent years, researches on applications of ceramic materials have been vigorously performed because of excellent characteristics of ceramic material with high resistance against abrasion, heat and acid. The ceramic materials are used in various kinds of rolling-mechanical part.

For instance, ceramic ball bearing not only demonstrates no occurrence of seizure, even when the supply of lubricant stops in the middle of its operation, but also has higher resistance against abrasion when compared with the metallic ball bearings.

Silicon-nitride compounds, silicon-carbide compounds, alumina compounds or titanium nitride compounds materials are mainly used in conventional ceramic materials to make ceramic ball bearings. There are many kinds of method for making ball bearings using ceramic materials. For example, the balls of the ball bearing can be manufactured by adding binder to ceramic powder to form a spherical shape and by sintering it.

However, it is difficult to get balls of high degree of spherical shape and good precision according to the abovementioned method. Also, it is actually impossible to manufacture these balls by press forming at high temperatures. Therefore, balls with a good degree of spherical shape, dimensions, precision, resistance against abrasion and good mechanical hardness can not be manufactured by the abovementioned method.

As a result, a grinding technology is adopted as an alternative method for making ceramic spheres. For example, in the grinding technology, a sphere can be made by constantly cutting the edges of a cube. However, since a sphere is approximately formed according to this prior art, there is a problem that a lot of time, special jigs and skilled persons are required.

On the other hand, the improved prior art is disclosed in Korean Patent Laid-open Publication No. 1987-268. In the prior art of grinding technology, a cylinder-shaped grinding grindstone in which several arc-shaped grooves are formed on the grind-surface and cylinder-shaped rowing grindstone are disposed in an approximate parallel. A blade is disposed between a grinding grindstone and a rowing grindstone. The blade has an inclined surface toward the rowing grinding grindstone.

However, in the abovementioned prior art, there is a disadvantage in that the original shape of grindstone can not be maintained due to abrasion. Consequently, the size of ceramic sphere becomes inconsistent as time passes. Therefore, the grinding grindstone should be changed frequently to maintain the sizes of ceramic spheres uniform. In addition, since the ceramic sphere is made out of a cylinder-shaped bar, the size of the ceramic sphere is limited.

BRIEF SUMMARY OF THE INVENTION

Therefore, the present invention is directed to solve the problems and drawbacks as mentioned above. An object of the present invention is to provide a method for making ceramic spheres by which a ceramic sphere can be easily manufactured by a simple mechanical apparatus.

Another object is to provide a method for making ceramic spheres in which the waste of raw material can be minimized.

A further object is to provide a method for making ceramic spheres wherein a precise sphere with a high degree can be obtained.

According to an aspect of the present invention for achieving the above objects, there is provided a method for making ceramic spheres, comprising the steps of preparing a cylinder-shaped core; disposing the core on a pair of rotating bodies arranged horizontally; rotating the rotating bodies; descending a core drill and bringing the core drill into contact with said core; machining a spherical body out of the core by rotating the core drill.

According to another aspect of the present invention, there is a method for making ceramic spheres, comprising the steps of disposing a spherical body on a pair of rotating bodies arranged horizontally; restricting upward movement of the spherical body by a location fixing member; rotating the rotating bodies and the core drill.

BRIEF DESCRIPTION OF THE SEVERAL VIEWS OF THE DRAWINGS

FIG. 2A to FIG. 2C are views illustrating the steps of manufacturing ceramic spheres in the method for making ceramic spheres, in which FIG. 2A is a front view, FIG. 2B is a side view and FIG. 2C is a perspective view;

FIG. 3A and FIG. 3B are views illustrating the steps of manufacturing ceramic real sphere in the method for making ceramic spheres according to the present invention, in which FIG. 3A is a front view and FIG. 3B is a side view.

DETAILED DESCRIPTION OF THE INVENTION

Hereinafter, a preferred embodiment of a method for making ceramic spheres according to the present invention will be explained in detail with reference to the accompanying drawings.

Figure 1:
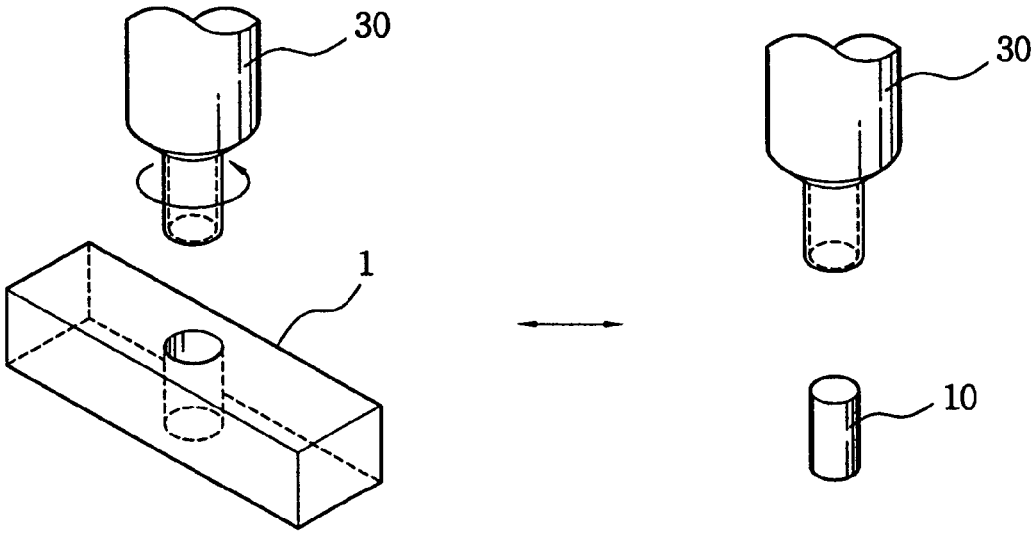
FIG. 1 is a view illustrating the steps of preparing a cylinder-shaped core in a method for making ceramic spheres according to the present invention.
Figure 2A:
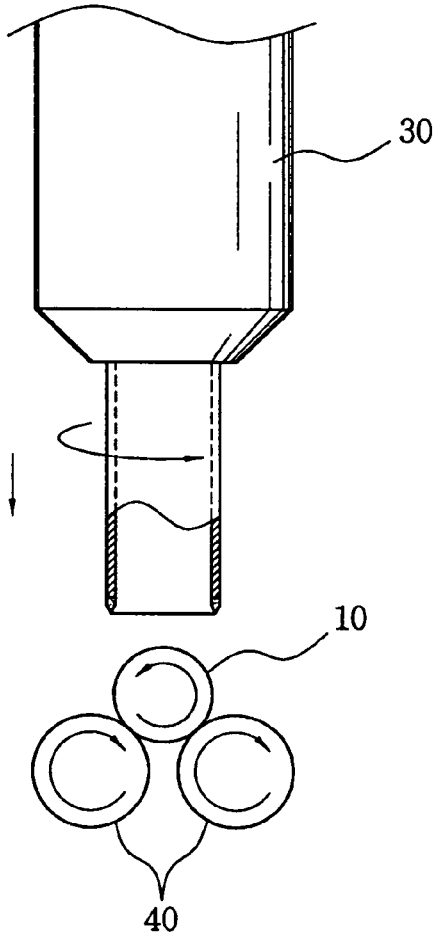
Figure 2B:
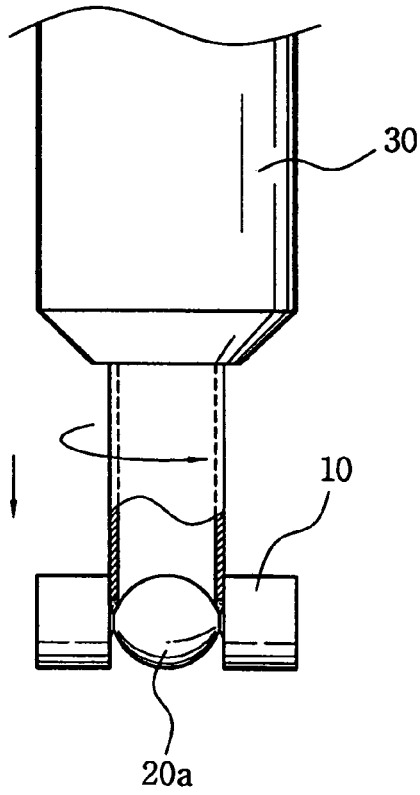
Figure 2C:
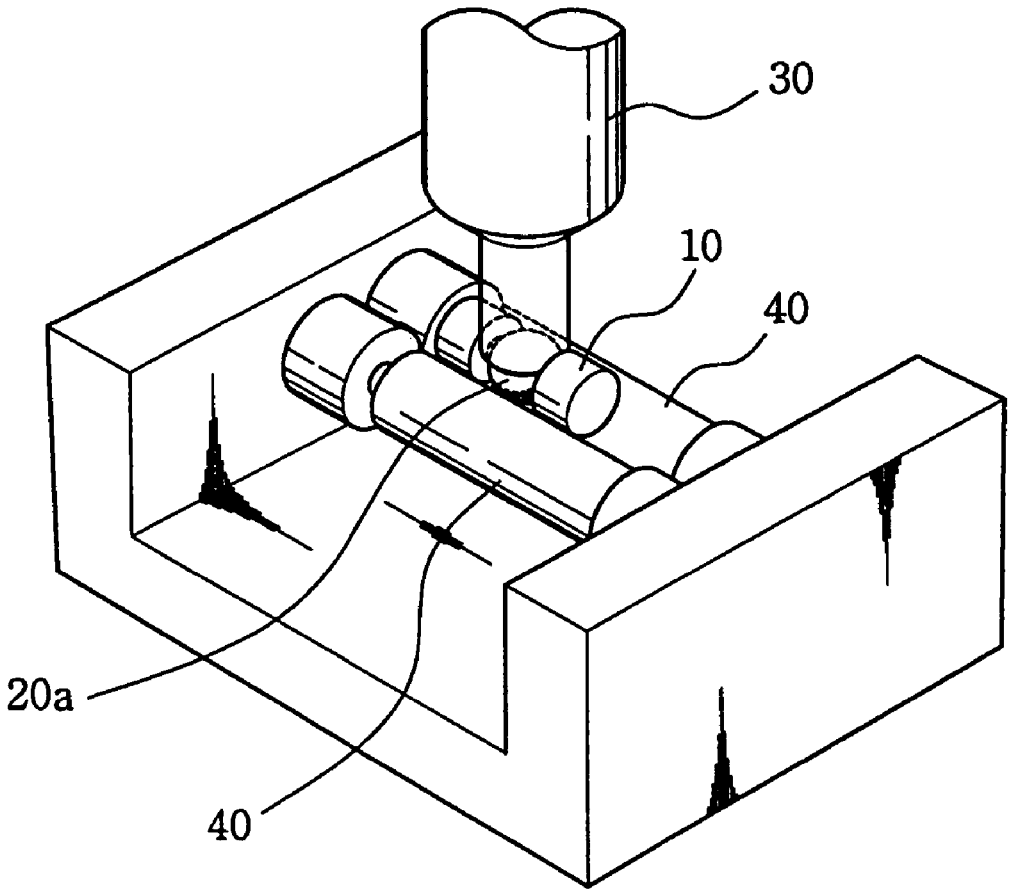
Figure 3A:
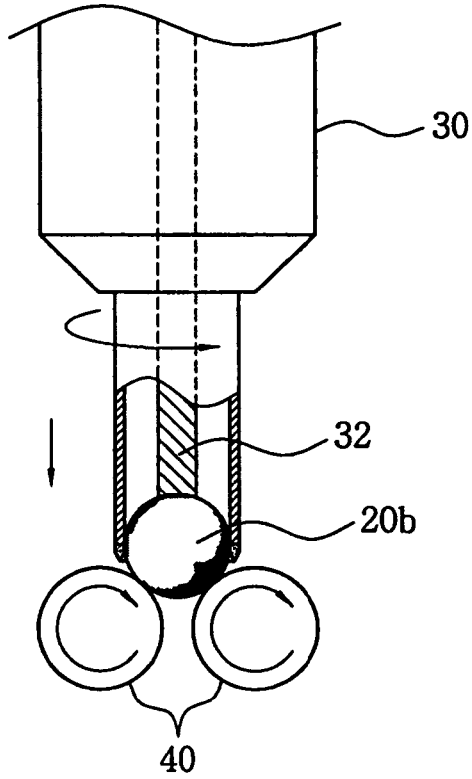
Figure 3B:
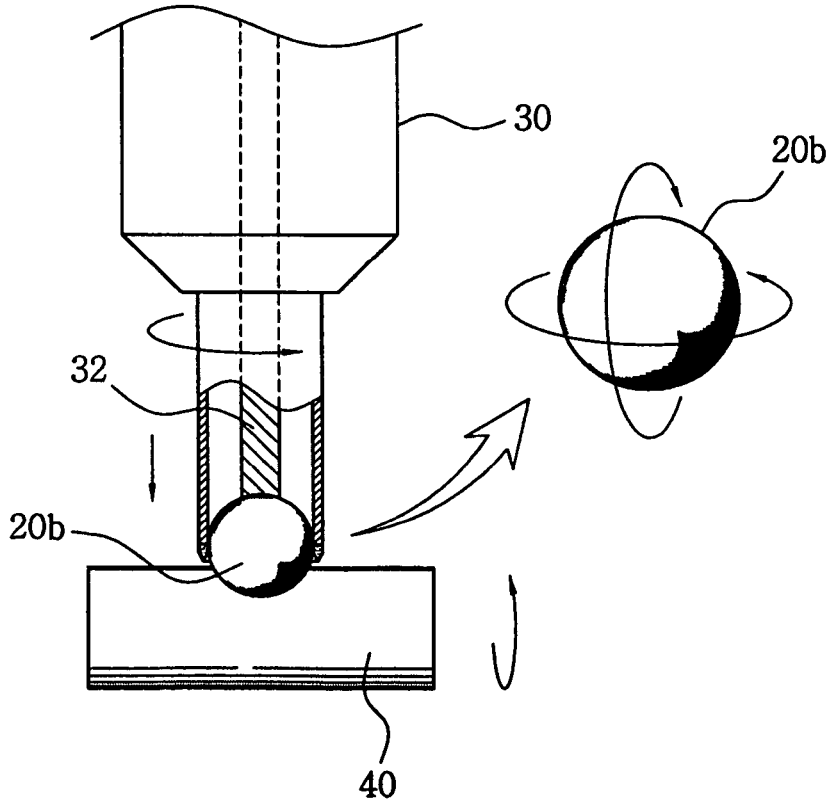

Referring FIG. 1 to FIG. 3, first of all, the structure of the apparatus for performing a method for making ceramic spheres according to the present invention is explained. In order to prepare a cylinder-shaped core 10 from raw material 1 and to obtain a ceramic sphere 20*a* out of the core 10 as shown in FIG. 2B, a core drill 30 is used in the present invention. Referring to FIG. 3A and FIG. 3B, in order to restrict the upward movement of the ceramic sphere 20*a*, a stopper 32 is mounted in the core drill 30. The stopper 32 can be ascended and descended. As the core drill 30, all the general core drills can be applied to the present invention. Since the core drills are well known to the ordinary skilled persons in the art, detailed descriptions of the core drill 30 will be omitted herein. Also, since the stopper 32 can be easily mounted in the core drill 30 by a person having ordinary skill in the art, detailed descriptions of the mounting of the stopper will be omitted herein.

Further, in the method for making ceramic spheres according to the present invention, as shown in FIG. 2A to FIG. 3C, the core 10 which is made by the core drill 30 is made into the ceramic sphere 20*a*. In order to make the ceramic sphere 20*a* into a ceramic real sphere 20*b* ultimately, a pair of rollers 40 are used in the present invention. Because the installation and disposition structure of the rollers is well-known, detailed descriptions thereof will be omitted.

Figure 4:
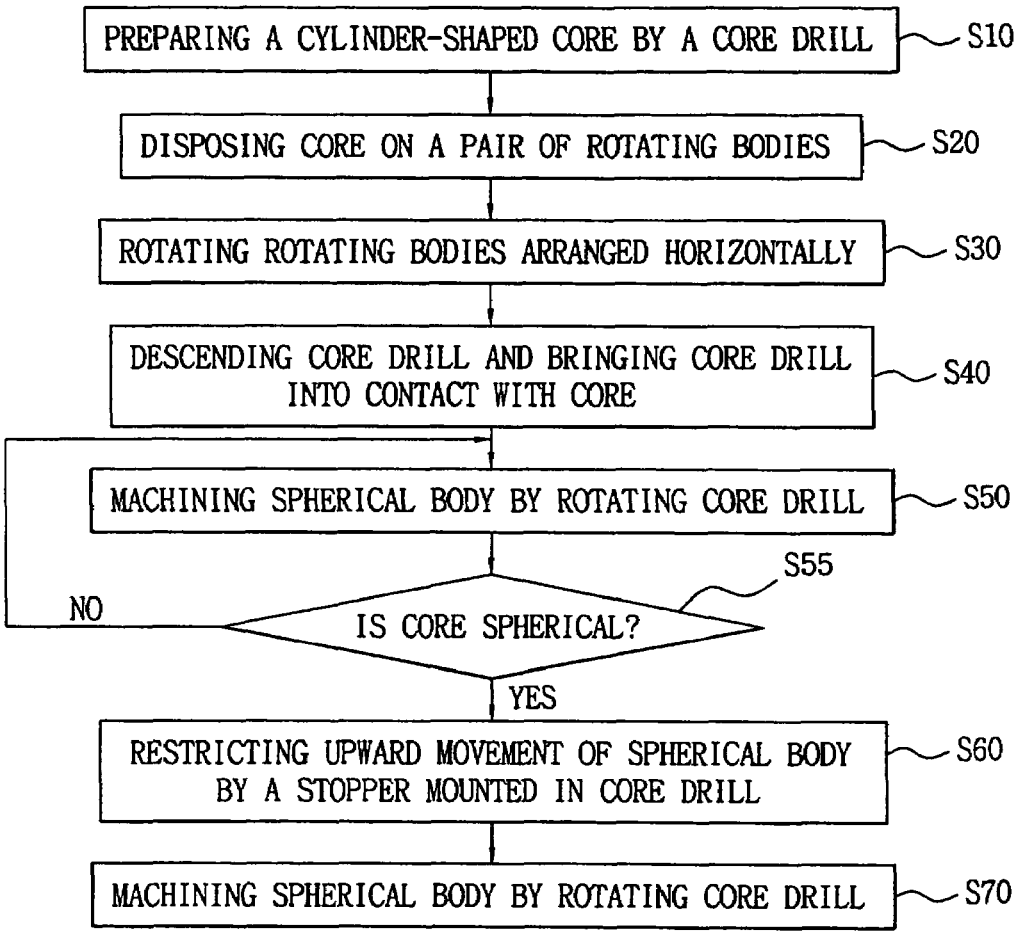
FIG. 4 is a flow chart showing a method for making ceramic spheres according to the present invention.

Hereinafter, a method for making ceramic spheres of the present invention is explained according to FIG. 4.

First, as shown in FIG. 1, by making the core 10 out of the ceramic raw material 1 by the core drill 30, the cylinder-shaped core 10 is prepared S10. The height of the prepared core 10 is preferably 1.5 times to 2 times longer than the diameter of the ceramic sphere 20*a*. Referring FIG. 2A, the prepared core 10 is disposed on the rollers 40 which are rotated horizontally S20. Then, as the rollers 40 are rotated, the core 10 on the rollers 40 is rotated in accordance with the rotations of the rollers 40.

Referring FIG. 2A to FIG. 2C, as a next step, the core drill 30 is descended to be brought into contact with the core 10 S40. Next, the core drill 30 is continuously rotated while keeping its contact with the core 10 S50. As the core drill 30 is rotated, a sphere begins to be formed out of the core 10. While the core 10 is grinded, whether the core 10 becomes spherical is examined S55. Until the core 10 becomes spherical, the grinding of the core 10 by the core drill 30 continues. Finally, the ceramic sphere 20*a* is obtained. Both ends of the ceramic sphere 20*a* remains still minutely unground.

In the above description, the operations of the rollers 40 and the core drill 30 are consecutively carried out to make the core 10 into the ceramic sphere 20*a*. However, it would be understood that the rollers 40 and the core drill 30 may be rotated simultaneously on the condition that the core 10 is in contact with the rollers 40 and the core drill 30.

Next steps indicate a method in which a real ceramic sphere 20*b* is made out of the ceramic sphere 20*a* which is primarily manufactured through the above mentioned steps S10 to S50. First, the stopper 32 mounted in the core drill 30 descends. As shown in FIG. 3A, the stopper 32 is in strong contact with the ceramic sphere 20*a* to restrict the upward movement of a ceramic sphere 20*a*. Thereafter, the ceramic sphere 20*a* is grinded by the core drill 30 in cooperation with the rollers 40. As a result, the ceramic real sphere 20*b* with high degree and precise dimension of diameter is obtained. This is because 3-dimensional grinding is performed. Namely, the ceramic sphere 20*a* is rotated simultaneously in both directions, as shown in FIG. 3B, by rotation of the core drill 30 and the rollers 40 while the upward movement of the ceramic sphere 20*a* is restricted.

In the above-described preferred mode, the serial steps from the step of preparing the cylinder-shaped core 10 to the step of machining the ceramic real sphere 20*b* via the step of machining the ceramic sphere 20*a* are described. However, the above-described steps may be selectively carried out according to the circumstances. For example, the cylinder-shaped core 10 may be prepared not by a core drill but by other various procedures to omit the step S10. The steps S60 and S70 may be omitted when the process of making a real sphere is not necessary. On the other hand, only the steps S60 and S70 may be applied to obtain a real sphere with precise dimension out of a sphere which is made by other method.

The preferred embodiment of the present invention has been described for the illustrative purposes, therefore, the invention is in no way limited to the embodiment described hereinabove. Various modifications of disclosed embodiments as well as other embodiments of the invention will become apparent to persons skilled in the art upon reference to the description of the invention. It is therefore contemplated that the appended claims will cover any such modification or embodiments as fall within the true scope of the invention. For example, in the above-mentioned mode, a ceramic material is used as a raw material, however, besides the ceramic material, any material which can not be shaped into a sphere by plastic working, like a mass of rock etc., may be available. Moreover, instead of the rollers, other rotating bodies may be adaptable to rotate the core and the ceramic sphere.

As described hereinabove, according to the method for making ceramic spheres of the present invention, a ceramic sphere can be easily manufactured by means of a simple mechanical apparatus and the waste of raw material can be reduced. In addition, a ceramic sphere which has high degree and precise dimension of diameter can be obtained.

What is claimed is:

1. A method of making ceramic spheres, wherein the method comprises the steps of:

preparing a cylinder-shaped core;

disposing the cylinder-shaped core on a pair of rotating bodies arranged horizontally;

rotating the rotating bodies;

descending a core drill and bringing the core drill into contact with said core; and machining a sphere out of the core by rotating the core drill.

2. A method as claimed in claim 1, wherein the method further comprises the step of restricting upward movement of the sphere by a location fixing member while machining the sphere out of the core by rotating the core drill.

3. A method as claimed in claim 2, wherein the location fixing member is a stopper movably mounted in the core drill.

4. A method as claimed in claim 1, wherein the cylinder-shaped core is made by the core drill.

5. A method as claimed in claim 4, wherein a height of said cylinder-shaped core is 1.5 to 2 times longer than a diameter of the cylinder-shaped core.

6. A method as claimed in claim 1, wherein the rotating bodies are rollers.

* * * * *